United States Patent [19]

Horodysky et al.

[11] 4,298,486

[45] Nov. 3, 1981

[54] FRICTION REDUCING ADDITIVES AND COMPOSITIONS THEREOF

[75] Inventors: Andrew G. Horodysky, Cherry Hill; Joan M. Kaminski, Clementon, both of N.J.

[73] Assignee: Mobil Oil Corporation, New York, N.Y.

[21] Appl. No.: 97,066

[22] Filed: Nov. 23, 1979

[51] Int. Cl.[3] ..... C10M 1/54; C10M 1/10

[52] U.S. Cl. ..... 252/49.6; 548/110; 548/347

[58] Field of Search ..... 252/49.6; 548/110, 347

[56] References Cited

U.S. PATENT DOCUMENTS

| | | | |
|---|---|---|---|
| 3,418,260 | 12/1968 | Trofimenko | 252/49.6 X |
| 3,446,808 | 5/1969 | Cyba | 252/49.6 X |
| 3,523,123 | 8/1970 | Wehrmeister | 548/347 X |
| 3,658,836 | 4/1972 | Vineyard | 252/49.6 X |

*Primary Examiner*—Andrew Metz

*Attorney, Agent, or Firm*—Charles A. Huggett; Michael G. Gilman; James D. Tierney

[57] ABSTRACT

Boric acid salts and borate esters of hydroxyethyl alkyl imidazolines are effective friction reducing additives when incorporated into lubricating compositions.

12 Claims, No Drawings

FRICTION REDUCING ADDITIVES AND COMPOSITIONS THEREOF

BACKGROUND OF THE INVENTION

1. Field of the Invention

This invention relates to lubricant additives and compositions thereof and, more particularly, to lubricant compositions comprising oils of lubricating viscosity or greases prepared therefrom containing a minor friction reducing amount of a boric acid salt or a borate ester of hydroxyalkyl alkyl or alkenyl imidazolines.

2. Description of the Prior Art

Many means have been employed to reduce overall friction in modern engines, particularly automobile engines. The primary reasons are to reduce engine wear thereby prolonging engine life and to reduce the amount of fuel consumed by the engine thereby reducing the engine's energy requirements or fuel consumption.

Many of the solutions to reducing fuel consumption have been strictly mechanical, as for example, setting the engines for a leaner burn or building smaller cars and smaller engines. However, considerable work has been done with lubricating oils, mineral and synthetic, to enhance their friction properties by modifying them with friction reducing additives.

Imidazolines have found widespread use in lubricating oils as additives for various purposes. However, the corresponding boric acid salts and borate ester derivatives to the best of applicants' knowledge are novel and have not been used as friction reducing additives in lubricant compositions.

SUMMARY OF THE INVENTION

This invention is directed to novel additive compounds, i.e., boric acid salts and borate esters of hydroxyalkyl alkyl imidazolines and hydroxyalkyl alkenyl imidazolines. In addition to these novel compounds the invention is also directed to lubricant compositions having reduced friction containing such compounds and to a method of reducing fuel consumption in internal combustion engines by treating the moving surfaces thereof with said compositions. Further the novel compounds referred to herein above also possess significant antioxidant characteristics and copper corrosion inhibiting properties.

DESCRIPTION OF SPECIFIC EMBODIMENTS

The generalized structure of the hydroxyalkyl or alkyl or alkenyl imidazolines before boration is:

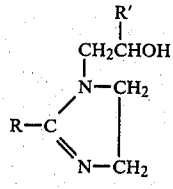

Such imidazolines may be readily obtained commercially or prepared in any convenient manner known to the art. The alkyl or alkenyl substituent (R) may contain any desirable number of carbon atoms based on such factors as solubility in oil but usually will contain from about 5 to about 25 carbon atoms. R' can be a hydrocarbyl substituent containing hydrogen or from 1 to 6 carbon atoms.

The borated derivatives are produced by the reaction of an imidazoline with boric acid in a suitable solvent or solvents at temperatures ranging from about 110° C. to about 250° C. Suitable solvents include hydrocarbon solvents such as toluene, xylene, etc. or alcoholic solvents such as butanol, pentanol, etc. Molar amounts of boric acid can be used to form essentially boric acid salts or an excess of boric acid can be used to form mixtures of boric acid salts and esters. Boration of the hydroxyalkyl alkyl or alkenyl imidazolines can also be accomplished with the use of a trialkyl borate such as tributyl borate. With the use of tributyl borate reaction temperatures of from 180° C. to about 280° C. are generally used, often in the presence of a hydrocarbon solvent. Boron levels can be as low as 0.05% or up to 10% and more depending upon the molecular weight of the imidazoline used and the quantity of boration reagent used. Specific reaction conditions and molar equivalents of the reactants well known in the art determine the nature of the final borated product.

The amount of additive required to be effective for reducing friction in lubricant compositions may range from 0.1 to about 10% by weight of the total lubricant composition. Preferred is from about 0.5 to 5 wt. %. In general, the additives of this invention may also be used in combination with other additive systems in conventional amounts for their known purpose.

The lubricants contemplated for use herein include both mineral and synthetic hydrocarbon oils of lubricating viscosity, mixtures of mineral and synthetic oils, and greases prepared therefrom. The synthetic hydrocarbon oils include long chain alkanes such as cetanes and olefin polymers such as oligomers ethylene, propylene, octene and decene. These synthetic oils can be mixed with other synthetic oils which include (1) ester oils such as pentaerythritol esters of monocarboxylic acids having 2 to 20 carbon atoms, (2) polyglycol ethers, (3) polyacetals and (4) siloxane fluids. Especially useful among the synthetic esters are those made from polycarboxylic acids and monohydric alcohols. More preferred are the ester fluids made from pentaerythritol, and an aliphatic monocarboxylic acid containing from 1 to 20 carbon atoms, or mixtures of such acids. The lubricants also can include solid lubricants such as greases.

Having described the invention in general terms, the following are offered as specific illustrations thereof. It is to be understood they are illustrations only and that the specification and the appended claims are not thereby limited.

EXAMPLE 1

Boric acid salt of 1-(2-hydroxyethyl)-2-heptadecenylimidazoline.

Approximately 2100 g. of 1-(2-hydroxyethyl)-2-heptadecenylimidazoline was charged to a 5 liter glass reaction vessel equipped with an agitator, thermometer and Dean-Stark tube fitted with a condenser. The agitator was started and 119 g. of boric acid and 40 g. butanol were added. The reactants were heated to 190° C. for 4 hours. Essentially no esterification occurred since less than 6 ml of water was collected. The solvent was removed by vacuum distillation. The boric acid salt was an oil soluble, brown solid at room temperature.

Analysis:

Carbon, Wt. %—81.1

Hydrogen, Wt. %—13.6
Oxygen, Wt. %—3.2

EXAMPLE 2

Borate Ester of 1-(2-hydroxyethyl)-2-heptadecenylimidazoline.

Approximately 1400 g. of 1-(2-hydroxyethyl)-2-heptadecenylimidazoline was reacted with 200 g. of boric acid and 120 g. toluene and 30 g. butanol as solvents. Heating was begun and water evolution was noted at 120°-130° C. After a period of 7 hours, up to a temperature of about 190° C., water evolution terminated. The solvents were removed by vacuum distillation. The product was an orange viscous liquid.

Analysis:
Nitrogen, Wt. %—7.5
Carbon, Wt. %—70.8
Hydrogen, Wt. %—10.8
Molecular Wt.—846

EXAMPLE 3

Borate ester of 1-(2-hydroxyethyl)-2-(1-ethylpentyl) imidazoline.

Approximately 50 g. of 1-(2-hydroxyethyl)-2-(1-ethylpentyl)imidazoline was charged to a 250 ml glass reactor equipped with an agitator, thermometer, and Dean-Stark tube fitted with a condenser. Agitation was begun and 12.4 g. boric acid, 40 g. toluene and 2 g. butanol were added. The reactants were heated to 135° C. over a period of 5 hours and a total of 8½ ml of water was collected. The solvent was removed by vacuum distillation and the resulting product was an orange viscous liquid.

Analysis:
Nitrogen, Wt. %—10.7
Carbon, Wt. %—58.2
Hydrogen, Wt. %—9.7

The additives prepared as above were then incorporated into several fully formulated engine oils and evaluated using the Low Velocity Friction Apparatus.

Low Velocity Friction Apparatus (LVFA)

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever cam-motor arrangement.

Procedure

The rubbing surfaces and 12–13 ml. of test lubricant are placed on the LVFA. A 500 psi load is applied, and the sliding speed is maintained at 30 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 40 fpm sliding speed. Freshly polished steel specimens are used for each run. The surface of the steel is parallel ground to 4 to microinches. The percentages by weight are percentages by weight of the total lubricating oil composition, including the usual additive package. The data are percent decrease in friction according to:

$$\frac{(U_k \text{ of oil alone}) - (U_k \text{ of Additive plus oil})}{(U_k \text{ of oil alone})} \times 100$$

Thus, the corresponding value for the oil alone would be zero for the form of the data used. Test results are reported in Tables 1 and 2.

TABLE 1

| Example No. | Additive Conc. Wt. % | Percent Change in Coefficient of Friction 5 Ft./Min. | 30 Ft./Min. |
|---|---|---|---|
| Base Blend A (5W-20)[a] | — | 0 | 0 |
| 1. Boric acid salt of 1-(2-hydroxy- | 2 | 42 | 28 |
| ethyl)-2-heptadecenylimidazoline | 1 | 32 | 16 |
| 2. Borate ester of 1-(2-hydroxy- | 4 | 42 | 31 |
| ethyl)-2-heptadecenylimidazoline | 2 | 42 | 32 |
| | 1 | 33 | 25 |
| | ½ | 23 | 17 |
| 3. Borate ester of 1-(2-hydroxy- | 1 | 16 | 16 |
| ethyl)-2-(1-ethyl- pentyl)imidazoline | | | |

[a]Base Blend A is a fully formulated 5W-20 engine oil having the following general characteristics: Kinematic Viscosity @ 100° C. - 6.8 cs @ 40° C. - 36.9 cs Viscosity Index - 143

TABLE 2

| Example No. | Additive Conc. Wt. % | Percent Change in Coefficient of Friction 5 Ft./Min. | 30 Ft./Min. |
|---|---|---|---|
| Base Blend B (10W-40)[b] | | | |
| 1. Boric acid salt of 1-(2-hydroxyethyl); | — | 0 | 0 |
| 2-heptadeceyl imidazoline | 2 | 37 | 31 |

[b]Base Blend B is a fully formulated 10W-40 engine oil having the following general characteristics: Kinematic Viscosity @ 100° C. - 14.3 cs @ 40° C. - 91.7

Example 1 was further tested in 1 and 3% blends in 200 second solvent paraffinic neutral (200" SPN) lubricating oil using ASTM D130-6. Good control of copper strip corrosivity was exhibited, the results were 1A and 1A.

Example 1 was subjected also to the B-10 Catalytic Oxidation test at 325° F. for 40 hours to determine its antioxidant properties. The test lubricant composition is subjected to a stream of air which is bubbled through the composition at a rate of 5 liters per hour at 450° F. for 24 hours. Present in the composition are metals commonly used as materials of engine construction, namely:

(a) 15.6 sq. in. of sand-blasted iron wire,
(b) 0.78 sq. in. of polished copper wire,
(c) 0.87 sq. in. of polished aluminum wire, and
(d) 0.167 sq. in. of polished lead surface.

Inhibitors for oil are rated on the basis of prevention of oil deterioration as measured by the increase in acid formation or neutralization number (NN) and kinematic viscosity (KV) occasioned by the oxidation. The results of the tests are reported in Table 3.

TABLE 3

| | Catalytic Oxidation Test 325° F./40 Hours | |
|---|---|---|
| Example No. | Additive Conc. Wt. % | Percent Increase in Viscosity of Oxidized oil @ KV @ 210° F. |
| Base Oil, 200" SPN | — | 27 |
| 1. Boric acid salt of 1-(2-hydroxyethyl)-2-heptadecenyl-imidazoline | 1 | 20 |
| | 3 | −1 |

From the data of Table 1 and Table 2 it is readily apparent that the subject borated additives can significantly improve the friction reducing properties of lubricants. The use of additive quantities of 2% or less of these surface active borated hydroxyalkyl alkyl imidazolines results in reductions of friction of up to 43% when blended into a fully formulated SAE 5W-20 automotive engine oil. In addition to being useful at low concentrations, these readily available compositions do not contain any potentially undesirable phosphorus, sulfur or metallic salts, but exhibit good additional oxidation and/or bearing-corrosion inhibiting properties. Copper corrosivity protection was rated 1A and it is noted that the oxidation life of the base oil was significantly increased by the addition of an additive in accordance herewith.

We claim:

1. A lubricant composition comprising a major amount of an oil of lubricating viscosity or grease prepared therefrom and a minor amount of an additive, effective for providing friction reducing, copper anticorrosion, and antioxidant properties to said composition consisting of a boric acid salt or borate ester of a hydroxylakyl alkyl or alkenyl imidazoline in which said imidazoline has the following generalized structure:

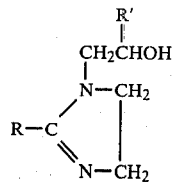

where R is $C_5$–$C_{25}$ alkyl or alkenyl and R′ is hydrogen or $C_1$–$C_{25}$ alkyl.

2. The composition of claim 1 wherein the additive is the boric acid salt of 1-(2-hydroxyethyl)-2-heptadecenylimidazoline.

3. The composition of claim 1 wherein the additive is the borate ester of 1-(2-hydroxyethyl)-2-heptadecenylimidazoline.

4. The composition of claim 2 wherein the additive is the borate ester of 1-(2-hydroxyethyl)-2-(1-ethylpentyl) imidazoline.

5. The composition of claim 1 wherein said oil is a mineral oil, synthetic oil or mixtures thereof.

6. A method of reducing fuel consumption in an internal combustion engine comprising treating the moving surfaces thereof with a lubricant composition as described in claim 1.

7. A borated compound prepared by reacting an hydroxyalkyl alkyl or alkenyl imidazoline and boric acid in a solvent or mixture of solvents at temperatures of from 110° to 200° C. under reaction conditions whereby a boric acid salt or a borate ester of said imidazoline is prepared wherein said imidazoline is represented by the formula:

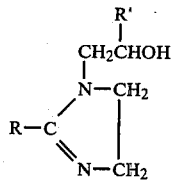

wherein R is $C_5$–$C_{25}$ alkyl or alkenyl group and $R^1$ is hydrogen or $C_1$–$C_6$ alkyl.

8. The borated compound of claim 7 wherein said compound is the boric acid salt of 1-(2-hydroxyethyl)-2-heptadecenylimidazoline.

9. The borated compound of claim 7 wherein said compound is the borate ester of 1-(2-hydroxyethyl)-2-heptadecenylimidazoline.

10. The borated compound of claim 7 wherein said compound is the borate ester of 1-(2-hydroxyethyl)-2-(1-ethylpentyl)imidazoline.

11. The composition of claim 1 wherein the composition comprises a major amount of a grease prepared from an oil of lubricating viscosity.

12. The composition of claim 11 wherein said oil of lubricating viscosity is a mineral oil, synthetic oil or mixtures thereof.

* * * * *